United States Patent [19]

Chester et al.

[11] Patent Number: 4,524,232

[45] Date of Patent: Jun. 18, 1985

[54] PROCESS FOR PRODUCING HIGH VISCOSITY INDEX LUBES

[75] Inventors: Arthur W. Chester, Cherry Hill; William E. Garwood, Haddonfield; Stanley J. Lucki, Runnemede; Samuel A. Tabak, Wenonah, all of N.J.

[73] Assignee: Mobil Oil Corporation, New York, N.Y.

[21] Appl. No.: 568,015

[22] Filed: Jan. 4, 1984

[51] Int. Cl.[3] ..... C07C 2/02

[52] U.S. Cl. ..... 585/517; 585/533

[58] Field of Search ..... 585/517

[56] References Cited

U.S. PATENT DOCUMENTS 4,414,423 11/1983 Miller ..... 585/517

*Primary Examiner*—Curtis R. Davis

*Attorney, Agent, or Firm*—A. J. McKillop; M. G. Gilman; J. F. Powers, Jr.

[57] ABSTRACT

A combination process for producing high viscosity index lubes from light olefins is provided wherein light olefins are first passed over a small pore zeolite and the liquid product therefrom is then processed over an intermediate pore zeolite to provide a lubricating oil with a higher viscosity, high Viscosity Index and low pour point in greater yield than obtained with either of the catalysts alone.

4 Claims, No Drawings

PROCESS FOR PRODUCING HIGH VISCOSITY INDEX LUBES

BACKGROUND OF THE INVENTION

This invention is directed to the manufacture of lubricating oils or lubes and more particularly to the manufacture of lubricating oils from olefins. In another aspect, this invention is directed to a combination process for the conversion of olefins over zeolite catalysts to lubricating oil of low pour point, high viscosity and high Viscosity Index. High yields are attainable by this process.

Copending application Ser. No. 492,855, filed May 9, 1983 discloses a wide variety of zeolites including ZSM-23 for the manufacture of lube oils from olefins; copending application Ser. No. 509,672 filed June 30, 1983, and now abandoned, relates to manufacture of lubricating oils derived from the conversion of olefins over fresh ZSM-23 zeolites and copending application Ser. No. 359,395, filed Mar. 18, 1982, deals with a method of converting olefins to hydrocarbon oils of low pour point and high viscosity index utilizing porous crystalline zeolite material as a catalyst. The conversion of olefins over ZSM-5 type zeolites is well known in the art. For example, recently issued U.S. Pat. No. 4,227,992, as well as the patents mentioned therein are excellent examples of the prior art in connection with this general subject.

U.S. Pat. No. 4,126,644 discloses the conversion of a liquid fraction from a Fischer-Tropsch synthesis, predominantly $C_5$–$C_{10}$ olefins, over zeolites of the ZSM-5 type in order to produce higher boiling products.

U.S. Pat. No. 3,322,848 is directed towards the manufacture of high VI, low pour point lube oils from $C_{10}$ to $C_{18}$ normal alpha-olefins, processing them over crystalline aluminosilicate zeolites other than those of the ZSM-5 type.

SUMMARY OF THE INVENTION

It has now been discovered that high viscosity index and high viscosity lubes may be produced from olefins in a combination process wherein light olefins, e.g., $C_3$–$C_4$, are first passed over a small pore zeolite such as HZSM-23 and the resultant liquid product with low branching, and boiling below the lube range is then processed over an intermediate pore zeolite of the ZSM-5 type. In this combination process, an oil of lubricating viscosity is obtained having a higher viscosity than that obtained with the small pore zeolite aone and higher VI than over an intermediate pore zeolite alone. This novel process provides higher yields of low pour point lubricating oils than those previously obtained in separate single stage reactions utilizing the aforementioned catalysts.

DESCRIPTION OF SPECIFIC EMBODIMENTS

The combination of this invention is directed to using small pore zeolite catalysts preferably ZSM-23 as described in U.S. Pat. No. 4,076,842 to produce lube oils by converting olefins, generally $C_3$ to $C_{18}$ olefins, at elevated temperatures and pressures to a liquid product characterized by low branching having a boiling point below the lube range and which is thereafter processed over an intermediate pore zeolite such as a ZSM-5 type to provide a lube oil fraction havin an enhanced viscosity index.

The process of the first stage of this invention, i.e., the stage wherein the olefins are contacted with the small pore zeolite, is carried out at temperatures ranging from about 350° F. to about 650° F. at pressures ranging from about 100 to about 5000 psig, and preferably from about 400 to about 2000 psig and at space velocities ranging from about 0.1 to about 10 WHSV and preferably from 0.2 to 2 WHSV. Similar process conditions may be utilized in the second stage.

As stated hereinabove the first stage in the instant combination process uses a small pore (less than about 5 Angstroms) zeolite catalyst preferably ZSM-23. ZSM-23 is described in U.S. Pat. No. 4,076,842 to Plank et al., the entire contents of which are incorporated herein by reference. The ZSM-23 catalysts utilized in this invention have essentially the same X-ray diffraction pattern as set forth in said U.S. Pat. No. 4,076,842. A substantially pure form of silica is used for synthesis, however, a preferred commercially available product is marketed under the name of HI-SIL, a finely divided silica in hydrated form contains trace impurities of $Al_2O_3$ and NaCl.

The original cations associated with ZSM-23 may be replaced by a wide variety of other cations according to techniques well known in the art. Typical replacing cations will include hydrogen, ammonium, and metal cations, including mixtures of the same. Of the replacing metallic cations, particular preference is given to cations of metals such as rare earth metals, manganese and calcium, as well as metals of Group II of the Periodic Table. The ZSM-23 catalyst used in the invention is preferably the hydrogen form. Typical ion exchange techniques would be to contact the ZSM-23 zeolite with a salt of the desired replacing cation or cations. Although a wide variety of salts can be employed, particular preference is given to chlorides, nitrates and sulfates. Representative ion exchange techniques are disclosed in a wide variety of patents, including U.S. Pat. No. 3,140,249, U.S. Pat. No. 3,140,251 and U.S. Pat. No. 3,140,253.

The ZSM-23 zeolite is preferably admixed with an inorganic material which serves as a binder in order to provide such desirable properties thereto as improved crush resistance. The binders or matrices are extremely well known in the art and include various inorganic oxides, such as silica, alumina, magnesia, zirconia, thoria, or combinations thereof. The preferred matrix is alumina.

The second stage catalyst utilized in this novel invention is preferably a ZSM-5 type such as HZSM-5 having an intermnediate pore size of greater than about 5 Agnstroms. ZSM-5 is described in greater detail in U.S. Pat. Nos. 3,702,886 and Re 29,948, the entire description contained within those patents, particularly the X-ray diffraction pattern of therein disclosed ZSM-5 are incorporated herein in their entirety by reference. The catalyst in the first and the second stages may be the same or different provided the relative required pore sizes are maintained. Other suitable ZSM-5 type zeolites that may be useful in the second stage are ZSM-11, ZSM-12, ZSM-35, ZSM-38, ZSM-48, their hydrogen forms and other similar materials with the proviso that these specific zeolites also have intermediate pore diameters, that is diameters greater than about 5 Angstroms.

ZSM-11 is described in U.S. Pat. No. 3,709,979. Said patent is incorporated herein in its entirety by reference.

ZSM-12 is described in U.S. Pat. No. 3,832,449. Said patent is incorporated in its entirety herein by reference thereto.

ZSM-35 is described in U.S. Pat. No. 4,016,245. Said patent is incorporated herein in its entirety by reference.

ZSM-38 is more particularly described in U.S. Pat. No. 4,046,859 and it is incorporated herein in its entirety by this reference.

ZSM-48 is described in U.S. Pat. No. 4,397,827, the entire contents of which are incorporated herein by reference.

Generally speaking lower or light olefins include from about $C_2$ to about $C_{16}$ olefins with from about $C_2$ to $C_8$ being preferred. The following examples are merely illustrations and as such do not limit this invention. In the examples the zeolite was prepared in 1/16" extrudate form (35 wt. % alumina binder), sized to 14–25 mesh, and 4.9 g placed in the ⅜" ID stainless steel micro-unit reactor. The reactor fill was then treated in situ with hydrogen at 900° F. for one hour to ensure a standard dried condition before the introduction of propylene. Standard run conditions were downflow, 0.5 WHSV.

EXAMPLE 1

HZSM-5, 40/1 $SiO_2/Al_2O_3$

Propylene was passed at 1500 psig over HZSM-5 extrudate having an alpha value of about 400 for a total of four days, the first two at an average catalyst temperature of 400° F., and the last two days at 450° F. Liquid recovery was 97 wt. %. The liquid was distilled, finally under vacuum to separate lube bottoms product, and portions of the bottoms were vacuum topped further to give several lube products with the following yields and properties:

| | Lube Yield, Wt. % | | | |
|---|---|---|---|---|
| | 38 | 31 | 23 | 18 |
| Gravity, °API | 36.7 | 36.3 | 36.2 | 34.8 |
| Specific | 0.8463 | 0.8433 | 0.8438 | 0.8519 |
| Pour Point, °F. | −50 | −50 | −50 | −40 |
| K.V. @ 40° C., cs | 26.42 | 32.88 | 38.87 | 59.06 |
| K.V. @ 100° C., cs | 4.61 | 5.14 | 5.67 | 7.37 |
| Viscosity Index | 81.6 | 76.8 | 78.0 | 80.5 |
| Viscosity SUS* @ 100° F. | 137 | 170 | 201 | 307 |

*Saybolt Universal Seconds

EXAMPLE 2

HZSM-23, 114/1 $SiO_2/Al_2O_3$

The zeolite in this example was prepared as described in U.S. Pat. No. 4,076,842, except that HI-SIL, a solid amorphous silica and aluminum sulfate were used instead of colloidal silica and sodium aluminate. The zeolite was synthesized in 24 hours at a crystallization temperature of 345° F. Propylene was charged over the extrudate catalyst for a total of four days, the first three at an average catalyst temperature of 411° F., and the last 461° F. Liquid recovery was 95 wt. %. Distillation of the liquid product gave the following results:

| | Lube Yield, wt. % | | |
|---|---|---|---|
| Properties | 30 | 22 | 18 |
| Gravity, °API | 38.0 | 37.2 | 36.1 |
| Specific | 0.8348 | 0.8388 | 0.8443 |
| Pour Point, °F. | −55 | −45 | −35 |
| K.V. at 40° C., cs | 16.98 | 23.07 | 29.35 |

-continued

| | Lube Yield, wt. % | | |
|---|---|---|---|
| Properties | 30 | 22 | 18 |
| K.V. at 100° C., cs | 3.61 | 4.37 | 5.18 |
| Viscosity Index | 90 | 94 | 106 |
| Viscosity, SUS @ 100° F. | 91 | 120 | 152 |

Viscosity indices are higher than those of Example 1, but viscosities are lower at the same yield level (90, 120, 152 SUS at 30, 22 and 18% yield versus 170, 201 and 307 SUS at 31, 23 and 18% yield respectively).

EXAMPLE 3

Propylene was charged over the extrudate catalysts of Examples 1 and 2 at 400° F. at several WHSV's and the temperatures listed in the table below. The liquid products had average carbon numbers ranging from 9.1 to 11.5, well below that necessary for lubricating oils ($>C_{20}$). The $CH_3$ groups per average molecule were determined by infra-red analysis.

TABLE I

BRANCHING COMPARISON
HZSM-23 vs. HZSM-5

| | $C_3$ = Conv. Wt. % | WHSV | Temp, °F. | Liquid Product Ave. C No. | Liquid Product $CH_3$ Groups Per Ave.. Molecule |
|---|---|---|---|---|---|
| HZSM-23 | 40 | 0.5 | 331 | 9.1 | 2.26 |
| HZSM-5 | 49 | 0.25 | 296 | 9.6 | 2.44 |
| HZSM-23 | 62 | 0.5 | 351 | 9.8 | 2.45 |
| HZSM-5 | 66 | 1.0 | 378 | 10.2 | 2.59 |
| HZSM-23 | 89 | 0.5 | 274 | 9.6 | 2.41 |
| HZSM-5 | 85 | 0.25 | 325 | 10.4 | 2.58 |
| HZSM-23 | 98 | 0.5 | 396 | 11.1 | 2.69 |
| HZSM-5 | 96 | 1.0 | 408 | 11.5 | 2.76 |

At about the same conversion level, the liquid products from HZSM-23 have fewer methyl groups than those from HZSM-5, demonstrating that HZSM-23 makes a more linear oligomer product than HZSM-5.

EXAMPLE 4

A blend of equal weights of even carbon number $C_6$–$C_{20}$ 1-olefins obtained from Shell Chemical Company (labelled Neodene 6, 8 etc and ranging in normal alpha olefin content from 95.2 to 97%) was processed over the HZSM-5 extrudate catalyst of example 1 and 1500 psig, for 5.7 days at 0.6–0.9 WHSV, 400°–450° F. The $CH_3$ groups per average molecule for this blend as determined by IR was 0.85. Liquid recovery was 99 wt. %. Distillation of the liquid product gave the following results.

| | Lube Yield, Wt. % | | | |
|---|---|---|---|---|
| | 58 | 53 | 48 | 26 |
| Gravity, °API | 39.7 | 38.8 | 39.1 | 37.7 |
| Specific | 0.8265 | 0.8309 | 0.8294 | 0.8363 |
| Pour Point, °F. | −20 | −15 | −10 | −15 |
| K.V. @ 40° C., cs | 14.75 | 17.43 | 18.99 | 29.93 |
| K.V. @ 100° C., cs | 3.50 | 3.90 | 4.12 | 5.54 |
| Viscosity Index | 116 | 118 | 119 | 124 |
| Viscosity SUS* @ 100° F. | 81 | 93 | 100 | 154 |

These results show that low branching leads to high yield of high viscosity index lubes, and demonstrate the advantages of the two-stage process. Viscosity is higher at the same yield level compared to HZSM-23 alone and viscosity index is higher compared to either HZSM-5 or HZSM-23 alone.

Although the present invention has been described with preferred emobidments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A process for synthesizing lubricating oils from $C_2$–$C_{16}$ olefins comprising passing an olefinic feedstock containing same in a first stage over a ZSM-23 catalyst or its hydrogen form under suitable conditions of time, temperature and pressure to form a liquid product boiling below the lube oil range and thereafter in a second stage passing the liquid effluent from said first stage over a ZSM-5 type catalyst having a pore size greater than about 5 angstroms or hydrogen form thereof under the same or other suitable conditions of time, temperature and pressure to further increase the carbon content of said liquid effluent and separating lubricant oil product from the second stage reaction zone.

2. The process of claim 1 wherein said olefins are $C_3$–$C_4$ alpha olefins or mixtures thereof.

3. The process of claim 1 wherein the respective catalysts are HZSM-23 and HZSM-5.

4. The process of claim 1 wherein said olefins have from about 2 to about 8 carbon atoms.

* * * * *